US011549315B2

(12) United States Patent
Hansen

(10) Patent No.: US 11,549,315 B2
(45) Date of Patent: Jan. 10, 2023

(54) METHOD FOR SEPARATING NESTED WELL TUBULARS IN GRAVITY CONTACT WITH EACH OTHER

(71) Applicant: Aarbakke Innovation AS, Bryne (NO)

(72) Inventor: Henning Hansen, Sirevåg (NO)

(73) Assignee: Aarbakke Innovation AS, Bryne (NO)

( * ) Notice: Subject to any disclaimer, the term of this patent is extended or adjusted under 35 U.S.C. 154(b) by 0 days.

(21) Appl. No.: 17/331,591

(22) Filed: May 26, 2021

(65) Prior Publication Data

US 2021/0404267 A1 Dec. 30, 2021

Related U.S. Application Data

(60) Provisional application No. 63/044,929, filed on Jun. 26, 2020.

(51) Int. Cl.

| | |
|---|---|
| ***E21B 29/10*** | (2006.01) |
| ***E21B 17/10*** | (2006.01) |
| ***E21B 43/112*** | (2006.01) |
| ***E21B 17/046*** | (2006.01) |

(52) U.S. Cl.

CPC ..... *E21B 17/0465* (2020.05); *E21B 17/1078* (2013.01); *E21B 29/10* (2013.01); *E21B 43/112* (2013.01)

(58) Field of Classification Search

CPC ..... E21B 29/06; E21B 29/10; E21B 17/1078; E21B 43/112

See application file for complete search history.

(56) References Cited

U.S. PATENT DOCUMENTS 1,683,858 A * 9/1928 Black ..... E21B 43/112 166/55.3
2,116,465 A * 5/1938 Patterson ..... E21B 43/112 166/55.3

(Continued)

FOREIGN PATENT DOCUMENTS

| | | |
|---|---|---|
| EP | 2085571 A2 | 8/2009 |
| WO | 00/37772 A1 | 6/2000 |
| WO | 0223843 A1 | 5/2002 |

OTHER PUBLICATIONS

Extended European Search Report dated Nov. 10, 2021, for European Patent Application No. 21180845.6.

(Continued)

*Primary Examiner* — Jennifer H Gay

(74) *Attorney, Agent, or Firm* — Richard A. Fagin

(57) ABSTRACT

A method for lifting a first well tubular nested in a second well tubular from contact with the second well tubular includes moving a wellbore intervention tool to a location where the first well tubular is in contact with the second well tubular. The well intervention tool is operated to displace a wall of the first tubular until either (i) the wall of the first tubular contacts the second tubular and separates the first tubular from contact with the second tubular, or (ii) an opening is made in the wall of the first tubular. After the opening is made, an object is displaced from the wall of the first tubular until the object contact the second tubular and lifts the first tubular from the second tubular, wherein a circumferentially continuous annular space is opened between the first well tubular and the second well tubular.

11 Claims, 7 Drawing Sheets

(56) References Cited

U.S. PATENT DOCUMENTS

| | | | | |
|---|---|---|---|---|
| 2,587,244 | A * | 2/1952 | Sweetman | E21B 29/02 175/4.6 |
| 4,309,891 | A * | 1/1982 | Pogonowski | B21D 39/20 72/453.01 |
| 4,809,790 | A | 3/1989 | Manchak, Jr. | |
| 6,581,455 | B1 | 6/2003 | Berger | |
| 9,109,437 | B2 * | 8/2015 | Rogers | E21B 29/10 |
| 9,169,721 | B2 * | 10/2015 | Rogers | E21B 29/10 |
| 10,273,787 | B2 * | 4/2019 | Montaron | E21B 17/1078 |
| 10,370,919 | B2 * | 8/2019 | Hansen | E21B 43/114 |
| 11,391,104 | B2 * | 7/2022 | Al-Abdulrahman | E21B 31/18 |
| 2007/0209797 | A1 * | 9/2007 | Brink | E21B 43/112 166/310 |
| 2008/0190602 | A1 * | 8/2008 | Palmer | E21B 17/10 166/241.1 |
| 2013/0255935 | A1 * | 10/2013 | Rogers | E21B 29/10 166/241.1 |
| 2013/0255967 | A1 * | 10/2013 | Rogers | E21B 43/105 166/380 |
| 2016/0237763 | A1 | 8/2016 | Grimsbo et al. | |
| 2016/0312587 | A1 * | 10/2016 | Montaron | E21B 29/06 |
| 2017/0030157 | A1 * | 2/2017 | Hansen | E21B 34/08 |

OTHER PUBLICATIONS

Examination report from Australian Application No. 2021204357, dated Mar. 15, 2022.

* cited by examiner

METHOD FOR SEPARATING NESTED WELL TUBULARS IN GRAVITY CONTACT WITH EACH OTHER

CROSS REFERENCE TO RELATED APPLICATIONS

Priority is claimed from U.S. Provisional Application No. 63/044,929 filed on Jun. 26, 2020 and incorporated herein by reference in its entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of subsurface well intervention. More specifically, the disclosure relates to methods for preparing a subsurface well for permanent sealing and abandonment.

When subsurface wellbores are to be permanently abandoned, the oil and gas industry has as an objective to permanently leave as many well tubulars, e.g., tubing, liner and casing in the well as possible. Leaving tubulars in the well may provide the benefit of saving considerable cost for removing, transport and disposal of the tubulars and leaving the tubulars in the well may greatly reduce safety and health hazards to personnel performing abandonment procedures. A substantial benefit in leaving tubulars in the well accrues to offshore wells, where the drilling and/or plug and abandonment rig cost for an operator is often very high.

Where a well has both casing and a tubing nested in the casing, both being disposed in the well, abandonment procedures that leave such tubulars in the well may require sealing an annular space between the casing and the tubing. A method to create a seal between the tubing and the casing is to place a barrier material, for example cement, in the annular space, the so-called "A-annulus." After sealing the A-annulus, a fluid barrier may be placed within the tubing. Such fluid barrier may comprise an expandable plug placed in the tubing and subsequently covered with cement.

However, wells are frequently drilled at inclined angles from vertical, even horizontal. Even when wells are drilled intended to be vertical, wells never precisely vertical. Even intended vertical wells tend to penetrate the ground at a non-zero angle, or inclination over at least part of the longitudinal extent. Since all wellbore tubulars are to some degree flexible, a tubing nested within a casing will have longitudinal contact with the casing along substantial areas of the casing string.

To illustrate the foregoing contact between tubing and casing, FIG. 1 illustrates part of a wellbore having a tubing "string" 12 ("tubing" hereafter for convenience) nested within a casing string 10 ("casing" hereafter for convenience). The wellbore is deviated from vertical, sometimes to fully horizontal deviation. The tubing 12 may be "jointed" tubing, that is, made by assembling segments ("joints") of tubing end to end. At the longitudinal ends of each tubing joint, typically 10 meters in length, there is a threaded coupling 14 to connect the tubing joint 12 to an adjacent tubing joint 12. The couplings 14 may have an external diameter larger than the external diameter of the tubing 12 between the longitudinal ends, such that the couplings 14 will be in contact with the inside of the casing 10 because of gravity. Due to the flexibility of the tubing joints, however, the tubing 12 will bend downward between the couplings 14 to make longitudinal contact, shown at 16, with the casing 10. As a result, a barrier material can be placed between the tubing 12 and the casing 10, but not efficiently or about the full circumference of the tubing 12 where the longitudinal contact between the tubing and the casing is present.

FIG. 2 is a cross sectional view of a tubing 12 in a casing 12 in a highly inclined wellbore, wherein the tubing 12 rests on the casing 10 by the action of gravity. The tubing 12 has so-called "micro tubes" 18 mounted externally. Such micro tubes 18 may be hydraulic power and control lines, electrical and/or fiber optic cables, etc. As one will observe, the tubing 12 is in contact with the casing 10 on the lower side, due to gravity and weight of the tubing 12.

FIG. 3 an arrangement of tubing and casing in a highly inclined well as FIG. 2, but without micro tubes.

Such contact as shown in FIGS. 1, 2 and 3 creates the challenge of placing a barrier material circumferentially between the tubing and the casing over the entire circumference, as pumping in such barrier material will not lift the tubing from contact with the casing so that the entire circumference may be filled with such barrier material. As a result, areas where the tubing is in contact with the casing will become possible leak paths.

There is a need for methods to lift tubing from casing to enable full-circumference filling of the A-annulus with barrier material.

SUMMARY

One aspect of the present disclosure is a method for lifting a first well tubular nested in a second well tubular from contact with the second well tubular. A method according to this aspect includes moving a wellbore intervention tool to a location where the first well tubular is in contact with the second well tubular. The well intervention tool is operated to displace a wall of the first tubular until either (i) the wall of the first tubular contacts the second tubular and separates the first tubular from contact with the second tubular, or (ii) an opening is made in the wall of the first tubular. After the opening is made, an object is displaced from the wall of the first tubular until the object contact the second tubular and lifts the first tubular from the second tubular, wherein a circumferentially continuous annular space is opened between the first well tubular and the second well tubular.

In some embodiments, the opening is created by a wellbore intervention tool conveyed into the first well tubular by at least one of slickline, wireline, spoolable rod and coiled tubing.

In some embodiments, the displacing an object comprises at least one of: (a) extending at least one of a bolt, a pin and a plug through the opening and into contact with the second well tubular, and (b) bending a flap created in the wall of the first wellbore by creating the at least one opening until the flap contacts the second well tubular.

In some embodiments, the at least one of a bolt, a pin and a plug comprises a self-drilling, self-tapping screw.

In some embodiments, the opening creating the flap is created by at least one of milling, chemical cutting and shaped explosive cutting.

In some embodiments, the first well conduit comprises a tubing.

In some embodiments, the second well conduit comprises a casing.

Some embodiments further comprise filling the circumferentially continuous annular space with a barrier material.

A method according to another aspect of this disclosure for lifting a first well tubular nested in a second well tubular from contact with the second well tubular includes the following. A wellbore intervention tool is moved to a selected position within the first well tubular. At least one radial expansion pin is extended outward from the wellbore intervention tool to plastically deform the first well tubular proximate the at least one radial expansion pin. A circumferentially continuous annular space is thereby opened between the first well tubular and the second well tubular.

Some embodiments further comprise extending a plurality of circumferentially spaced apart radial expansion pins from the wellbore intervention tool. The plurality of circumferentially spaced apart radial expansion pins are disposed at a same longitudinal position along the wellbore intervention tool as each other.

Some embodiments further comprise filling the circumferentially continuous annular space with a barrier material.

A method according to another aspect of this disclosure for lifting a first well tubular nested in and in contact with a second well tubular disposed in a well includes moving a wellbore intervention tool to a location along the first well tubular where the first well tubular is in contact with the second well tubular. The well intervention tool is operated so as to displace a wall of the first well tubular until either (i) the wall of the first well tubular contacts the second well tubular and separates the first well tubular from contact with the second well tubular, or (ii) an opening is made in the wall of the first well tubular. After the opening is made at least one of the following is performed: (a) extending at least one of a bolt, a pin and a plug through the opening and into contact with the second well tubular; and (b) bending a flap created in the wall of the first wellbore by creating the at least one opening until the flap contacts the second well tubular. A circumferentially continuous annular space is opened between the first well tubular and the second well tubular.

In some embodiments, the at least one of a bolt, a pin and a plug comprises a self-drilling, self-tapping screw.

In some embodiments, the opening creating the flap is created by at least one of milling, chemical cutting and shaped explosive cutting.

In some embodiments, the first well conduit comprises a tubing.

In some embodiments, the second well conduit comprises a casing.

Some embodiments further comprise filling the circumferentially continuous annular space with a barrier material.

In some embodiments, the displacing the wall of the first well tubular comprises extending a plurality of circumferentially spaced apart radial expansion pins from the wellbore intervention tool, the plurality of circumferentially spaced apart radial expansion pins disposed at a same longitudinal position along the wellbore intervention tool as each other.

Other aspects and possible advantages will be apparent from the description and claims that follow.

DETAILED DESCRIPTION

As a general explanation of methods according to the present disclosure, such methods include moving a wellbore intervention tool to a predetermined location along a first well tubular nested inside a second well tubular. The predetermined location may be where the first tubular is in contact with the second tubular so as to circumferentially interrupt an annular space between the first well tubular and the second well tubular, as explained in the Background section herein. The well intervention tool is operated so as to displace a wall of the first well tubular. Displacement of the wall of the first well tubular may be in the form of localized bending or creating an opening. Displacing the wall of the first tubular continues until either (i) in the case of localized bending, the wall of the first well tubular contacts the second well tubular and separates the first well tubular from contact with the second well tubular, or (ii) an opening is made in the wall of the first well tubular. Un the case where an opening is made in the wall of the first well tubular, at least one of the following is performed: (a) extending at least one of a bolt, a pin and a plug through the opening and into contact with the second well tubular, and (b) bending a flap created in the wall of the first wellbore by creating the at least one opening until the flap contacts the second well tubular, wherein a circumferentially continuous annular space is opened between the first well tubular and the second well tubular. Various example embodiments of methods according to the disclosure will now be explained with reference to FIGS. 4 through 9.

Figure 4:
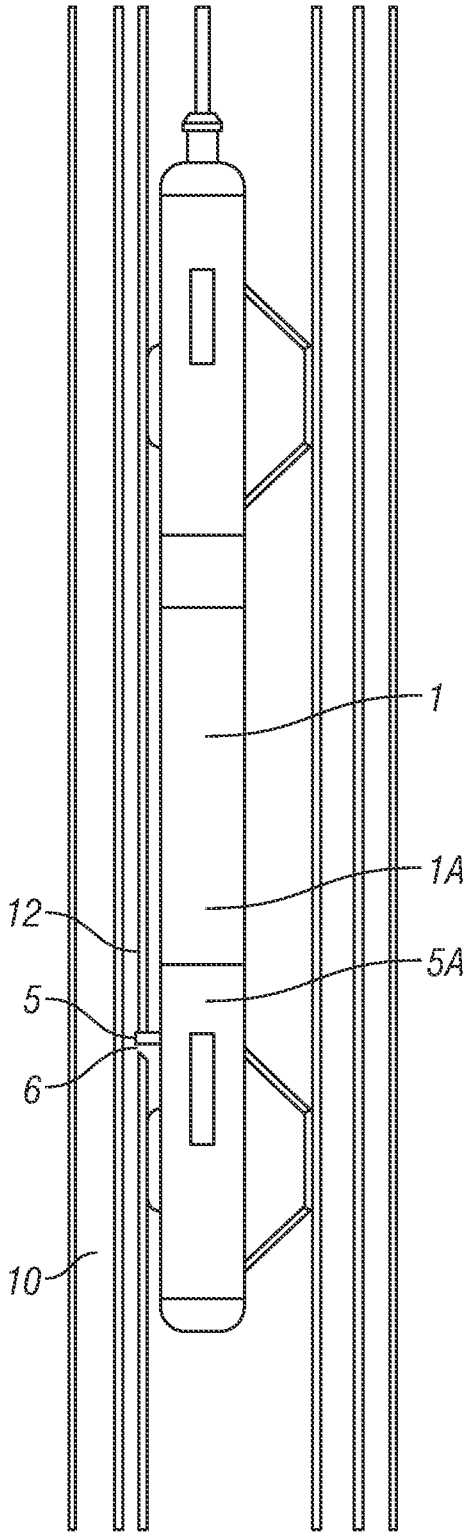
FIG. 4 illustrates an example embodiment of wellbore intervention tool.

FIG. 4 illustrates an example embodiment of wellbore intervention tool 1. In the present example embodiment, the wellbore intervention tool may be used to displace the wall of the first well tubular to create one or more openings in the first well tubular, e.g., the tubing 12. The first well tubular, e.g., the tubing 12 as explained above, is nested in a second well tubular, e.g., the casing 10. The wellbore intervention tool 1 may be, for example, a tool as described in U.S. Pat. No. 10,370,919 issued to Hansen et al. The wellbore intervention tool 1 can create one or more openings in the tubing 12 using a penetration device 5 extended laterally outwardly from a tool housing 1A, and one or more penetrations 6 or openings made through the tubing 12. The penetration device 5 may be mechanically or hydraulically extended from the housing 1A by a power module 5A. The power module 5A may comprise a motor to rotate the penetration device 5 and an extension mechanism to selectively extend the penetration device a determinable lateral distance from the housing 1A. The penetration device 5 may comprise a means for penetrating the wall of the tubing 12, such as a drill bit, punch, ram or any other device that may be deployed by the wellbore intervention tool to create an opening in the tubing 12.

The wellbore intervention tool 1 may also have the capability of inserting a plug, bolt, pin or other device through the one or more openings 6 after retracting the penetration device 5 as more fully set forth in the Hansen et al. '919 patent.

The wellbore penetration tool 1 may be conveyed into the well using any known conveyance, including conveyances that do not require the use of a wellbore tubular hoisting apparatus such as a drilling unit or workover unit. For example, the conveyance may be armored electrical cable (wireline), coiled tubing, slickline or semi-rigid spoolable rod deployed from a winch Thus, the one or more penetrations 6 may be made without the use of such tubular hoisting apparatus.

Figure 5:
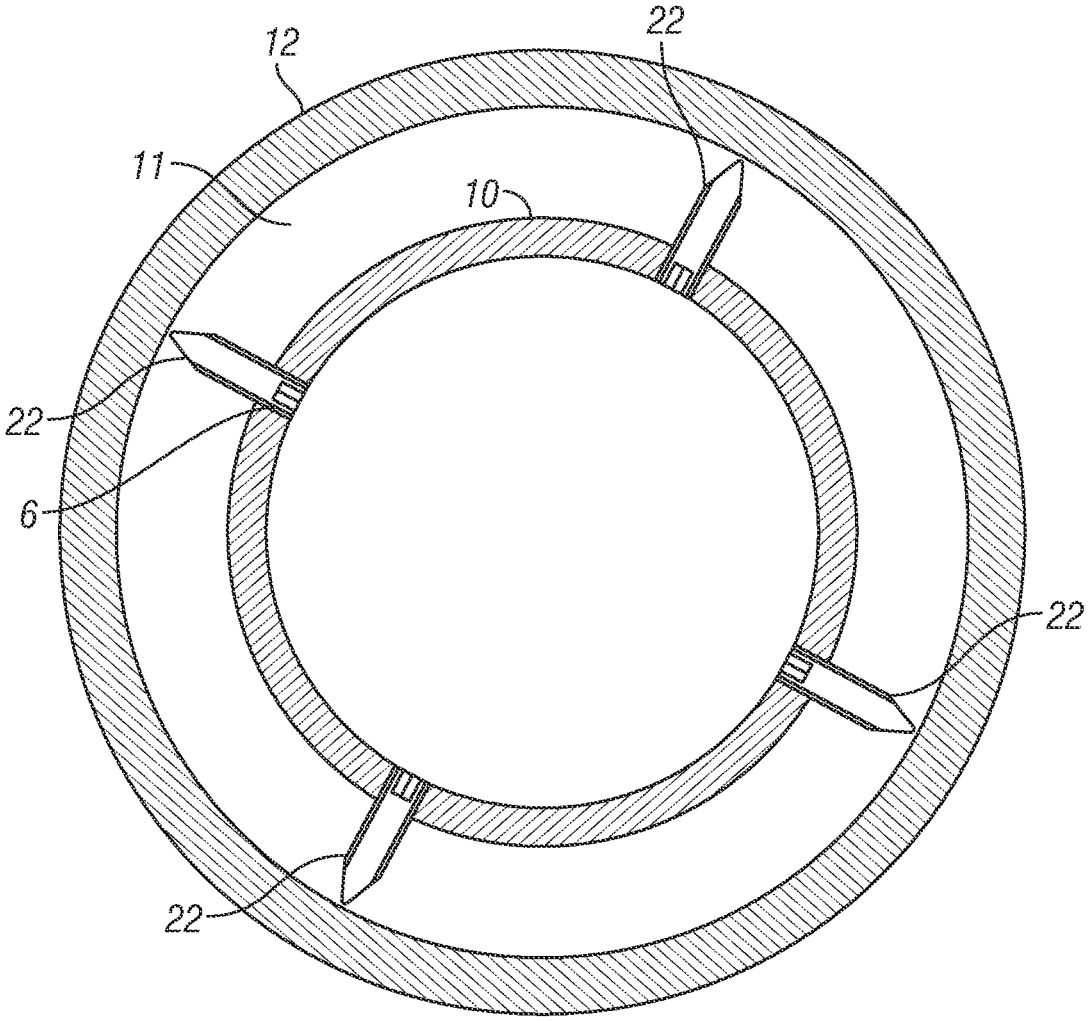
FIG. 5 illustrates how several bolts may be inserted through the tubing wall.

After making the one or more penetrations 6 in the tubing 12, and referring to FIG. 5, a bolt, plug, pin or any similar device, shown at 22, may be inserted by the wellbore intervention tool (1 in FIG. 4) in each opening 6 made in the tubing 12 through the tubing wall, so that the tubing 12 is lifted up from the casing 10, i.e., moved away from contact with the casing 10. A suitable device that performed the function of a pin, bolt or plug is any shaped element that may be moved through the penetrations or openings 6 to urge the tubing 12 out of contact with the casing 10. Thus, irrespective of the form or shape, any other device that performs such function is within the scope of this disclosure.

While the outer or second well tubular is referred to as a casing, it will be appreciated that the present disclosure applies equally to liner, which is a well tubular that does not extend in a well back to the Earth's surface. The bolts, plugs, pins or similar devices 22 may be moved into the tubing wall, for example, by threading or by interference fit. In some embodiments, bolts 22 may be self-drilling, self-tapping screws that can be axially urged and rotated by the wellbore intervention tool (1 in FIG. 4) such that it is unnecessary to create the penetrations or openings 6 prior to insertion of the bolts 22. The number of bolts, pins or plugs 22 is not critical, but it may be reasonably expected that 2 to 4 of bolts, pins, or plugs circumferentially spaced apart from each other should be sufficient to lift the tubing 12 to provide a circumferentially continuous annular space 11 between the tubing 12 and the casing 10, depending on the ability of the wellbore intervention tool (1 in FIG. 4) to place the pins, plugs or bolts in the respective penetrations 6 (or self-drilling self-threading screws, if used).

Figure 1:
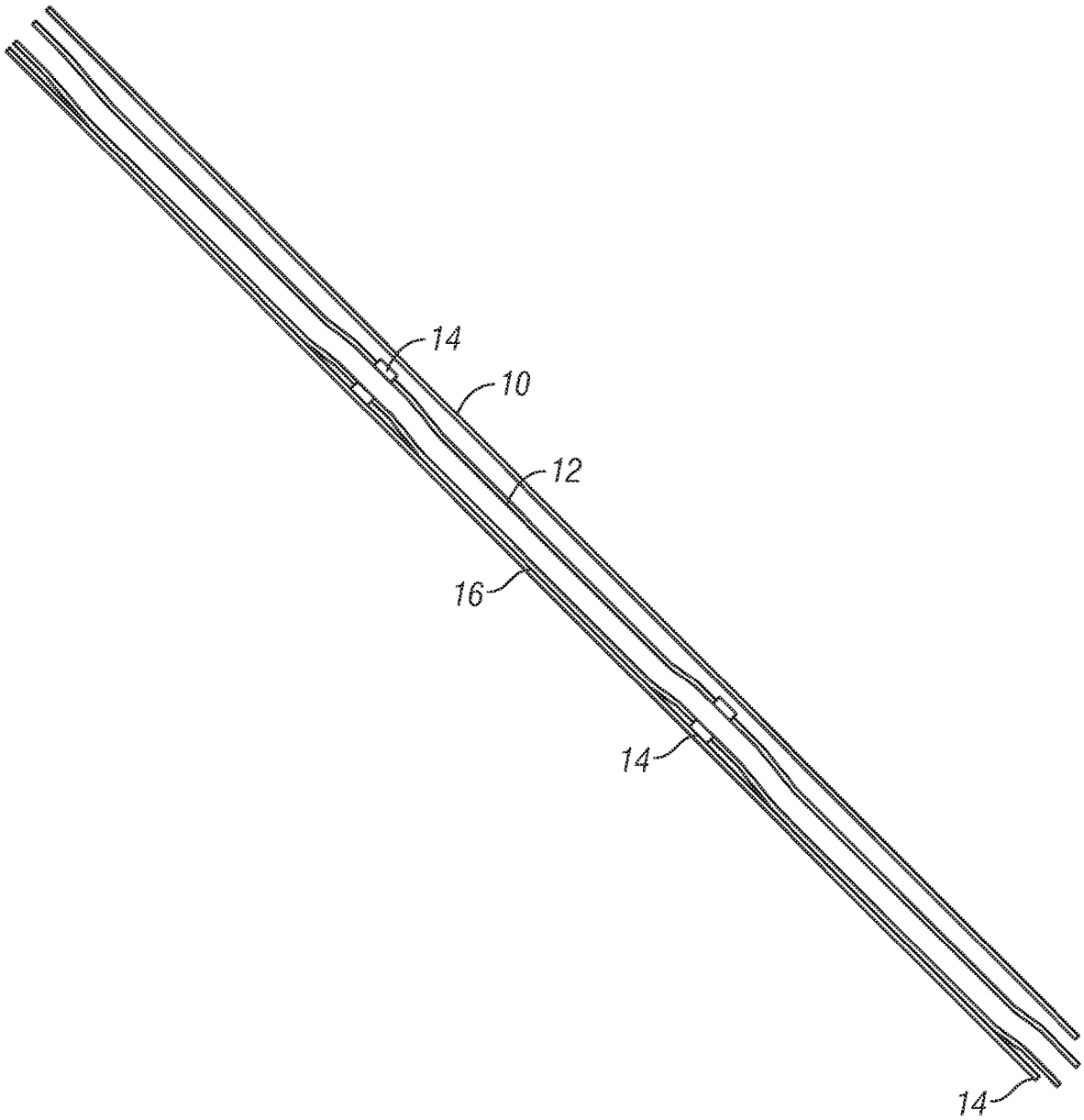
FIG. 1 (Prior Art)
FIG. 1 illustrates a tubing string within a casing string in a non-vertical (deviated) wellbore.
Figure 2:
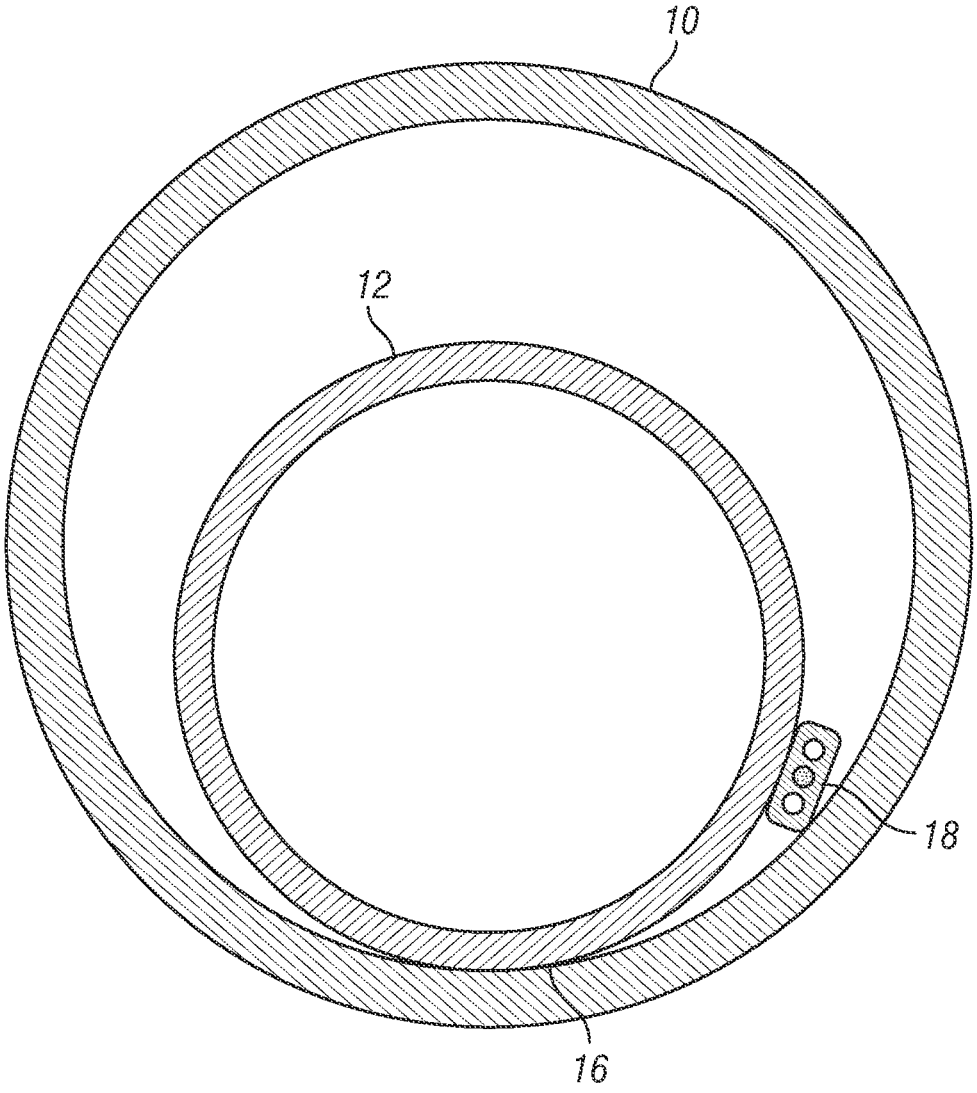
FIG. 2 (Prior Art)
FIG. 2 illustrates the tubing string placed within a casing.
Figure 3:
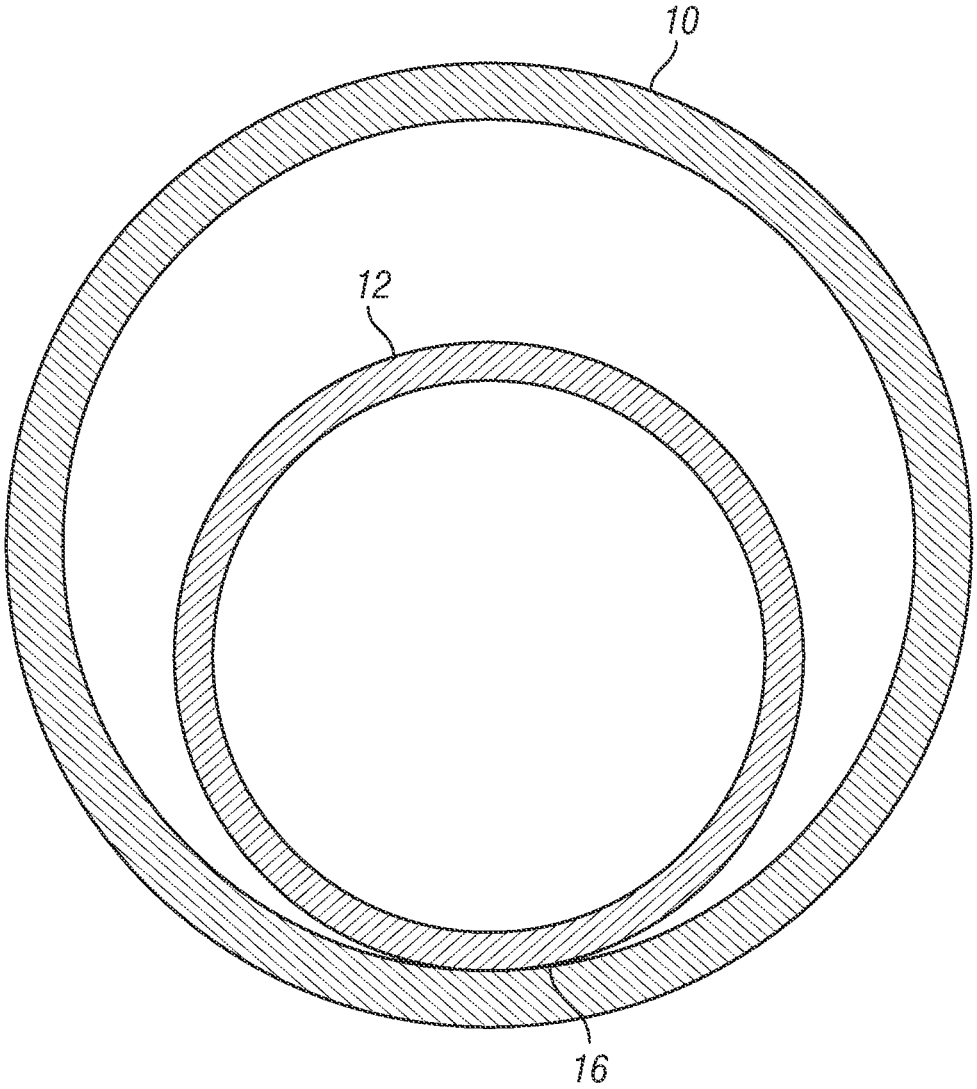
FIG. 3 (Prior Art)
FIG. 3 illustrates the same as FIG. 2, but with no "micro tubes".
Figure 6:
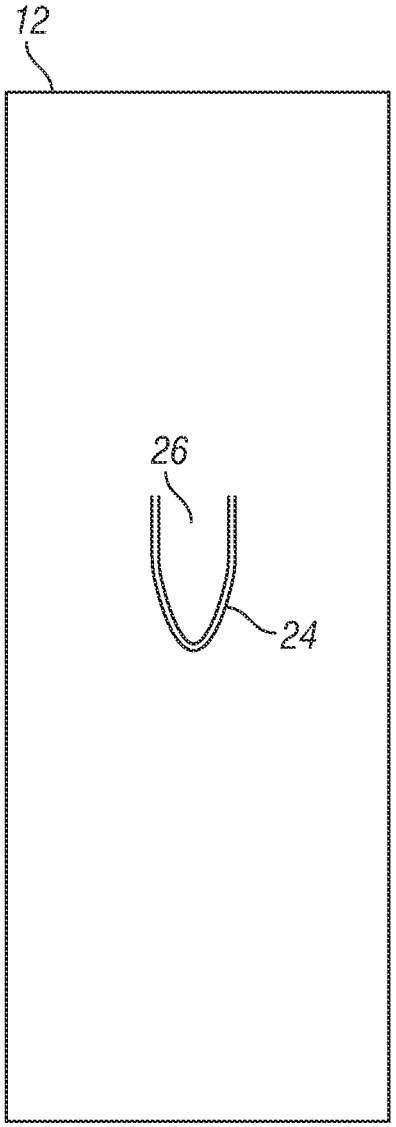
FIG. 6 illustrates another method of lifting the tubing from the casing by creating a bendable flap in the wall of the tubing.

FIG. 6 illustrates another example embodiment of a method for lifting the tubing 12 from the casing 10, where the wellbore intervention tool (1 in FIG. 1) or another tool displaces or cuts the wall of the tubing 12 in one or more places in a pattern 24 to create a bendable flap 26 at such cut. The wellbore intervention tool (1 in FIG. 4) or another tool may then push the flap 26 outwardly to cause the flap 26 to contact the interior wall of the casing 10. Continued bending of the flap 26 will then lift the tubing 12 from the casing (10 in FIG. 5). In some embodiments, pushing the flap 26 outwardly toward the casing (10 in FIG. 5) may comprise extending the penetration device (5 in FIG. 4) into the flap 26. The penetration device (5 in FIG. 4) may be operated so that it only exerts radially outward force against the flap 26 but does not operate to create an opening in the flap 26. The pattern 24 may be, for example, a V or U shaped cut in the wall of the tubing 12, however the exact shape of the pattern 24 is only limited by the criteria that the flap 24 remains attached to the tubing 12 and provides sufficiently strong structure to support the local weight of the tubing 12 when it is lifted from the casing 10 after the flap 24 is bent outward. The wellbore intervention tool (1 in FIG. 4) or another tool may pushing the flap 26 outward by the use of, for example, hydraulic energy.

The pattern 24 may be cut, for example and without limitation, by a rotary mill, flame, chemical cutter or shaped explosive cutter conveyed by the wellbore intervention tool or another tool.

Figure 7:
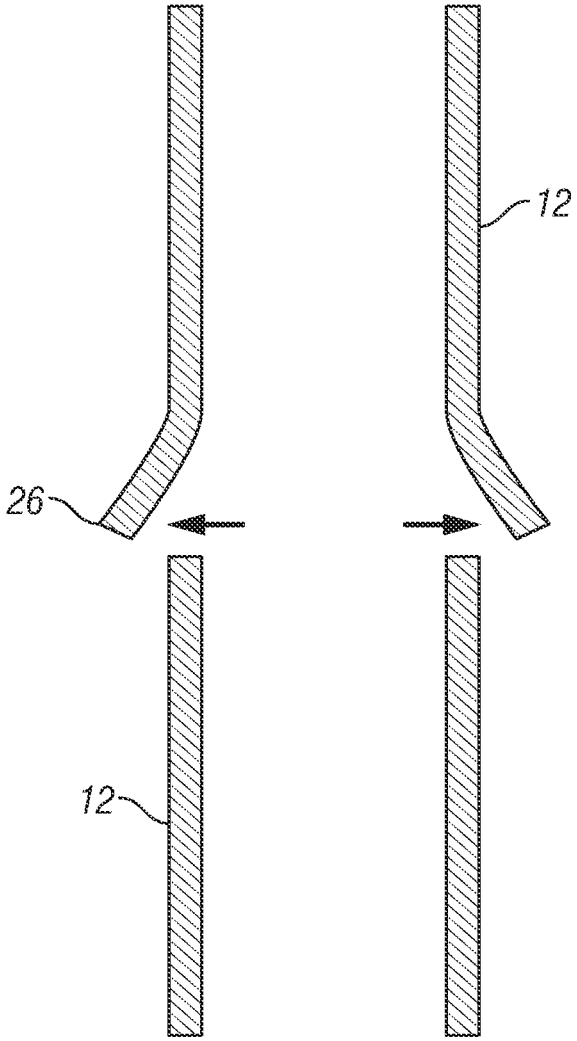
FIG. 7 shows a cross-sectional view of two flaps in the tubing as in FIG. 6, bent outwardly to move the tubing away from the interior wall of the casing.

FIG. 7 illustrated how the flap(s) 26 are shaped after bending in order to contact the casing (10 in FIG. 5) to lift the tubing 12 from the casing.

After the tubing 12 is lifted from the casing 10 to create a circumferentially continuous annular space (see FIG. 5) according to any of the herein described embodiments, further operations may be conducted, such as filling part of the annular space with barrier material.

Figure 9:
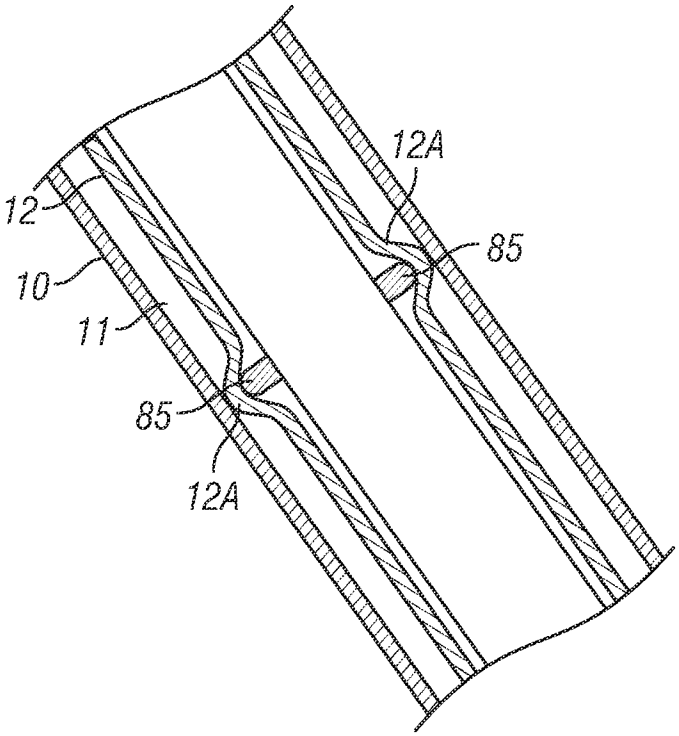
FIG. 9 an area of contact between a radial contact pin and the tubing may plastically deform when using an apparatus as in FIG. 8.
Figure 8:
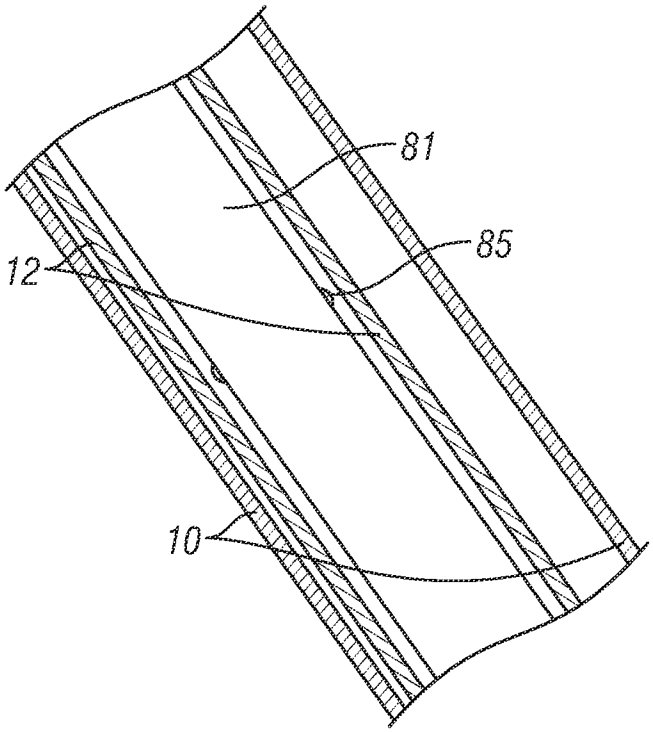
FIG. 8 shows another example embodiment.

In another possible embodiment, shown in FIG. 8, a wellbore intervention tool 81 may be disposed in the tubing 12 to a depth at which it is desired to lift the tubing 12 from contact with the casing 10. The wellbore intervention tool 81 may comprise one or more, circumferentially spaced apart, if more than one is used, radially extensible tubular expansion pins 85. The example embodiment shown in FIG. 8 comprises two circumferentially spaced apart radial expansion pins 85, however, in various embodiments, more or fewer such radial expansion pins may be used. The radial expansion pins 85 may be any convenient shape enabling radial retraction substantially or entirely within the wellbore intervention tool 81 for movement along the interior of the tubing 12, and having means for radially extending (not shown) the radial expansion pin 85 at preprogrammed times or by control from the surface. Means for radially extending may include, without limitation, a piston or ram disposed in an hydraulic cylinder, a motor, ball nut and jack screw combination, or any other suitable device to urge the respective radial expansion pin 8 outwardly from the wellbore intervention tool 81. FIG. 9 shows that when sufficient force is applied to the radial expansion pin(s) 85, an area of contact, shown at 12A, between the radial contact pin 85 and the tubing 12 may plastically deform. The area of contact then serves to lift the tubing 12 from contact with the casing 10 so as to create a circumferentially continuous annular space 11 in the vicinity of the contact area 12A. In embodiments of a wellbore intervention tool having more than one circumferentially spaced apart radial expansion pin, e.g., two as shown in FIG. 9, the radial expansion pins may be disposed at substantially the same longitudinal position along the wellbore intervention tool so that reactive force from expanding the tubing 12 may be made substantially neutral with respect to the axis of the wellbore intervention tool 81. "Substantially at the same longitudinal position" in the present context includes any differences between respective longitudinal positions necessitated by space limitations within the wellbore intervention tool 81.

Methods according to the present disclosure for lifting a well tubing from a well casing may enable placing a barrier material without the need to use a hoist to pull the tubing out of the casing, thereby saving time and cost.

In light of the principles and example embodiments described and illustrated herein, it will be recognized that the example embodiments can be modified in arrangement and detail without departing from such principles. The foregoing discussion has focused on specific embodiments, but other configurations are also contemplated. In particular, even though expressions such as in "an embodiment," or the like are used herein, these phrases are meant to generally reference embodiment possibilities, and are not intended to limit the disclosure to particular embodiment configurations. As used herein, these terms may reference the same or different embodiments that are combinable into other embodiments. As a rule, any embodiment referenced herein is freely combinable with any one or more of the other embodiments referenced herein, and any number of features of different embodiments are combinable with one another, unless indicated otherwise. Although only a few examples have been described in detail above, those skilled in the art will readily appreciate that many modifications are possible within the scope of the described examples. Accordingly, all such modifications are intended to be included within the scope of this disclosure as defined in the following claims.

What is claimed is:

1. A method for lifting a first well tubular nested in and in contact with a second well tubular disposed in a well, comprising:

moving a wellbore intervention tool to a location along the first well tubular where the first well tubular is in contact with the second well tubular;

creating a flap in the wall of the first wellbore tubular;

operating the well intervention tool so as to displace the flap until the flap contacts the second well tubular and separates the first well tubular from contact with the second well tubular, wherein a circumferentially continuous annular space is opened between the first well tubular and the second well tubular.

2. The method of claim 1 wherein the flap is created by at least one of milling, chemical cutting and shaped explosive cutting.

3. The method of claim 1 wherein the first well tubular comprises a tubing.

4. The method of claim 1 wherein the second well tubular comprises a casing.

5. The method of claim 1 further comprising filling the circumferentially continuous annular space with a barrier material.

6. A method for lifting a first well tubular nested in and in contact with a second well tubular disposed in a well, comprising:

moving a wellbore intervention tool to a location along the first well tubular where the first well tubular is in contact with the second well tubular;

operating the well intervention tool to create a flap in a wall of the first tubular at the location; and bending the flap created in the wall of the first wellbore tubular until the flap contacts the second well tubular and displaces the first well tubular from the second well tubular, wherein a circumferentially continuous annular space is opened between the first well tubular and the second well tubular.

7. The method of claim 6 wherein the flap is created by a wellbore intervention tool conveyed into the first well tubular by at least one of slickline, wireline, spoolable rod and coiled tubing.

8. The method of claim 6 wherein the flap is created by at least one of milling, chemical cutting and shaped explosive cutting.

9. The method of claim 6 wherein the first well tubular comprises a tubing.

10. The method of claim 6 wherein the second well tubular comprises a casing.

11. The method of claim 6 further comprising filling the circumferentially continuous annular space with a barrier material.

* * * * *